US006500059B2

(12) United States Patent
Chang et al.

(10) Patent No.: US 6,500,059 B2
(45) Date of Patent: Dec. 31, 2002

(54) APPARATUS AND METHOD FOR MOUNTING A WAFER IN A POLISHING MACHINE

(75) Inventors: Yi-Sen Chang, Chu-tung (TW); Hsien-Shu Tsai, Hsin Chu (TW)

(73) Assignee: Taiwan Semiconductor Manufacturing Company, Ltd, Hsin Chu (TW)

( * ) Notice: Subject to any disclaimer, the term of this patent is extended or adjusted under 35 U.S.C. 154(b) by 19 days.

(21) Appl. No.: 09/728,354

(22) Filed: Dec. 1, 2000

(65) Prior Publication Data

US 2002/0068512 A1 Jun. 6, 2002

(51) Int. Cl.[7] ..... B24B 47/00

(52) U.S. Cl. ..... 451/388; 451/289; 451/397; 451/398

(58) Field of Search ..... 451/289, 388, 451/397, 398; 279/3

(56) References Cited

U.S. PATENT DOCUMENTS 6,315,649 B1 * 11/2001 Hu et al. ..... 451/28

* cited by examiner

*Primary Examiner*—Timothy V. Eley
*Assistant Examiner*—Alvin J. Grant
(74) *Attorney, Agent, or Firm*—Tung & Associates

(57) ABSTRACT

A wafer mounting plate for use in a polishing apparatus is disclosed. The wafer mounting plate includes a metal plate and a screen mounted to a top surface of the metal plate. The metal plate is normally formed of circular shape and provided with a plurality of vacuum passageways therethrough. The metal plate has a bottom surface for engaging a membrane member and a wafer by vacuum through the plurality of vacuum passageways, and a top surface for engaging a pressurizing means, such as a pneumatic gasket. The screen mounted to the top surface of the metal plate has a multiplicity of apertures each of a size not larger than 0.5 mm in diameter. The screen is mounted sandwiched between the top surface of the metal plate and the pressurizing means. The screen effectively prevents debris of a wafer breakage from entering a vacuum system that is used for holding the wafer on the wafer mounting plate. The invention further discloses a wafer carrying head for use in a chemical mechanical polishing apparatus which includes a carrier body, a pressurizing means and a support plate equipped with a screen thereon.

19 Claims, 2 Drawing Sheets

APPARATUS AND METHOD FOR MOUNTING A WAFER IN A POLISHING MACHINE

FIELD OF THE INVENTION

The present invention generally relates to an apparatus and a method for mounting a wafer in a polishing machine and more particularly, relates to an apparatus and a method for mounting a wafer to a wafer mounting plate in a polishing machine capable of preventing contamination to a vacuum line upon the occurrence of a wafer breakage.

BACKGROUND OF THE INVENTION

Apparatus for polishing thin, flat semi-conductor wafers is well-known in the art. Such apparatus normally includes a polishing head which carries a membrane for engaging and forcing a semiconductor wafer against a wetted polishing surface, such as a polishing pad. Either the pad, or the polishing head is rotated and oscillates the wafer over the polishing surface. The polishing head is forced downwardly onto the polishing surface by a pressurized air system or, similar arrangement. The downward force pressing the polishing head against the polishing surface can be adjusted as desired. The polishing head is typically mounted on an elongated pivoting carrier arm, which can move the pressure head between several operative positions. In one operative position, the carrier arm positions a wafer mounted on the pressure head in contact with the polishing pad. In order to remove the wafer from contact with the polishing surface, the carrier arm is first pivoted upwardly to lift the pressure head and wafer from the polishing surface. The carrier arm is then pivoted laterally to move the pressure head and wafer carried by the pressure head to an auxiliary wafer processing station. The auxiliary processing station may include, for example, a station for cleaning the wafer and/or polishing head; a wafer unload station; or, a wafer load station.

More recently, chemical-mechanical polishing (CMP) apparatus has been employed in combination with a pneumatically actuated polishing head. CMP apparatus is used primarily for polishing the front face or device side of a semiconductor wafer during the fabrication of semiconductor devices on the wafer. A wafer is "planarized" or smoothed one or more times during a fabrication process in order for the top surface of the wafer to be as flat as possible. A wafer is polished by being placed on a carrier and pressed face down onto a polishing pad covered with a slurry of colloidal silica or alumina in de-ionized water.

A schematic of a typical CMP apparatus is shown in FIGS. 1A and 1B. The apparatus 10 for chemical mechanical polishing consists of a rotating wafer holder 14 that holds the wafer 10, the appropriate slurry 24, and a polishing pad 12 which is normally mounted to a rotating table 26 by adhesive means. The polishing pad 12 is applied to the wafer surface 22 at a specific to pressure. The chemical mechanical polishing method can be used to provide a planar surface on dielectric layers, on deep and shallow trenches that are filled with polysilicon or oxide, and on various metal films. CMP polishing results from a combination of chemical and mechanical effects. A possible mechanism for the CMP process involves the formation of a chemically altered layer at the surface of the material being polished. The layer is mechanically removed from the underlying bulk material. An altered layer is then regrown on the surface while the process is repeated again. For instance, in metal polishing a metal oxide may be formed and removed repeatedly.

A polishing pad is typically constructed in two layers overlying a platen with the resilient layer as the outer layer of the pad. The layers are typically made of polyurethane and may include a filler for controlling the dimensional stability of the layers. The polishing pad is usually several times the diameter of a wafer and the wafer is kept off-center on the pad to prevent polishing a non-planar surface onto the wafer. The wafer is also rotated to prevent polishing a taper into the wafer. Although the axis of rotation of the wafer and the axis of rotation of the pad are not collinear, the axes must be parallel. Polishing heads of the type described above used in the CMP process are shown in U.S. Pat. No. 4,141,180 to Gill, Jr., et al.; U.S. Pat. No. 5,205,082 to Shendon et al; and, U.S. Pat. No. 5,643,061 to Jackson, et al. It is known in the art that uniformity in wafer polishing is a function of pressure, velocity and the concentration of chemicals. Edge exclusion is caused, in part, by non-uniform pressure on a wafer. The problem is reduced somewhat through the use of a retaining ring which engages the polishing pad, as shown in the Shendon et al patent.

Referring now to FIG. 1C, wherein an improved CMP head, sometimes referred to as a Titan® head is shown. The Titan® head differs from conventional CMP heads in two major respects. First, the Titan® head employs a compliant wafer carrier and second, it utilizes a mechanical linkage (not shown) to constrain tilting of the head, thereby maintaining planarity relative to a polishing pad 12, which in turn allows the head to achieve more uniform flatness of the wafer during polishing. The wafer 10 has one entire face thereof engaged by a flexible membrane 16, which biases the opposite face of the wafer 10 into face-to-face engagement with the polishing pad 12. The polishing head and/or pad 12 are moved relative to each other, in a motion to effect polishing of the wafer 10. The polishing head includes an outer retaining ring 14 surrounding the membrane 16, which also engages the polishing pad 12 and functions to hold the head in a steady, desired position during the polishing process. As shown in FIG. 1C, both the retaining ring 14 and the membrane 16 are urged downwardly toward the polishing pad 12 by a linear force indicated by the numeral 18 which is effected through a pneumatic system.

A more detailed cross-sectional view of the improved CMP 20 is shown in FIG. 1D. The CMP head 20 further includes a wafer mounting plate 30, a bumper ring 32, an inner tube 34 for supplying the pneumatic force 18 (shown in FIG. 1C) and a base plate 36. The bumper ring 32 is utilized between the wafer 10 and the mounting plate 30 for preventing edge defect by raising the edges of wafer 10 when pressed down onto a polishing pad (not shown). Without the use of the bumper ring 32, the edge portion of the wafer 10 is not polished to the same degree as the center portion of the wafer 10 and therefore, the bumper ring 32 compensates for the poor polishing along the edges of wafer 10 by providing a support behind the wafer. Both the bumper ring 32 and the wafer mounting plate 30 are normally fabricated of a rigid material such as plastic or ceramic. The wafer mounting plate 30 is further provided with a plurality of through holes 40, as shown in FIG. 2A.

FIGS. 2A and 2B illustrate a plane view and a side view, respectively of the wafer mounting plate 30 shown in FIG. 1D. The plurality of through holes 40, or apertures, are provided for fluid communication between an upper surface 38 and a lower surface 42 of the wafer mounting plate 30 which enables a vacuum to be exerted on the wafer 10 when positioned thereunder. It should be noted that the flexible membrane member 16, shown in FIG. 1D, is not shown in FIGS. 2A and 2B for simplicity reasons. The flexible membrane member 16 may be fabricated of a breathable material, or a material that is perforated such that vacuum can be pulled on the membrane member for acting on the wafer surface. The flexible member 16 may be advantageously fabricated of an elastomeric material, such as a silicon rubber, a polyurethane rubber or any other high temperature and chemical resistant rubber that does not cause particle contamination.

In the configuration shown in FIGS. 2A, 2B and 1D, the wafer mounting plate 30 when used to mount wafer 10 frequently encounters wafer breakage problem since both the mounting plate 30 and the bumper ring 32 are fabricated of a rigid material which leads to a stress concentration on the wafer. Wafer breakage occurs during wafer loading or unloading from a load cup, or during wafer chucking or dechucking from a polishing pad. When wafer breakage occurs, not only the throughput of the fabrication process, but also the vacuum line and the vacuum source can be severely affected. The debris from a broken wafer can cause severe contamination in the vacuum system.

It is therefore an object of the present invention to provide an apparatus for mounting a wafer in a polishing machine that does not have the drawbacks or shortcoming of the conventional apparatus.

It is another object of the present invention to provide a wafer mounting plate for use in a polishing apparatus capable of preventing contamination in a vacuum line when wafer breakage occurs.

It is a further object of the present invention to provide a wafer mounting plate for use in a polishing apparatus that is equipped with a screen mounted on top for preventing debris from a broken wafer to contaminate a vacuum source for holding the wafer.

It is still another object of the present invention to provide a wafer mounting plate that has a screen adhered thereon for preventing broken wafers from contaminating a vacuum source in fluid communication with the wafer mounting plate.

It is another further object of the present invention to provide a wafer carrying head in a chemical mechanical polishing apparatus that is effective in preventing contamination to a vacuum line by debris from a broken wafer.

It is yet another object of the present invention to provide a wafer carrying head in a chemical mechanical polishing apparatus which includes a support plate that has a screen mounted thereon for preventing debris of a broken wafer from contaminating the vacuum system used in holding the wafer.

It is still another further object of the present invention to provide a method for mounting a wafer in a polishing machine by first adhering a screen onto a wafer mounting plate such that debris from a broken wafer does not contaminate a vacuum system used for holding the wafer.

SUMMARY OF THE INVENTION

In accordance with the present invention, an apparatus and a method for mounting a wafer in a polishing machine onto a metal plate that is equipped with a screen for preventing debris of a broken wafer from entering a vacuum system used for holding the wafer.

In a preferred embodiment, a wafer mounting plate for use in a polishing apparatus is provided which includes a metal plate of circular shape that has a plurality of holes therethrough, the metal plate has a bottom surface for engaging a membrane member and a wafer by vacuum through the plurality of holes and a top surface for engaging a pressurizing means; and a screen mounted to and contacting the top surface of the metal plate wherein the screen has a multiplicity of apertures each has a size not larger than 0.5 mm in diameter, the screen being mounted sandwiched between the top surface of the metal plate and the pressurizing means.

In the wafer mounting plate for use in a polishing apparatus, the plurality of holes in the metal plate each has a diameter of not smaller than 5 mm. The membrane member may be perforated with holes for vacuum to be pulled therethrough, the membrane member may further be fabricated of a material that has a flexibility sufficient for preventing wafer breakage during loading or unloading of a wafer in the polishing apparatus, or may be fabricated of an elastomeric material that has a Durometer A scale of less than 70. The screen may have a thickness of less than 2 mm. The plurality of apertures each has a size that is sufficiently small for preventing debris of a broken wafer from being sucked into the vacuum system. The multiplicity of apertures in the screen may each have a size between about 0.01 mm and about 0.5 mm, and preferably between about 0.02 mm and about 0.08 mm. The top surface of the metal plate may further include a raised edge portion adapted for containing the screen therein by frictional engagement, i.e. instead of by adhesive means.

The present invention is further directed to a wafer carrying head in a chemical mechanical polishing apparatus which includes a carrier body of generally circular shape for receiving a pressurizing means, a support plate and a wafer therein; a pressurizing means situated in the carrier body for exerting a downward pressure on the support plate; and a support plate of circular shape that has a plurality of vacuum passageways therethrough, a top surface and a bottom surface, the bottom surface engages a wafer by vacuum through a membrane member, the top surface is covered by a screen that has a multiplicity of apertures therethrough each having a diameter not larger than 0.5 mm for mating to the pressurizing means and for preventing any debris of a broken wafer from being sucked into the vacuum.

In the wafer carrying head for use in a chemical mechanical polishing apparatus, the membrane member may have perforations therethrough, the membrane member may have a flexibility sufficient to prevent wafer breakage during wafer loading and unloading in the chemical mechanical polishing apparatus. The plurality of vacuum passageways each has a diameter of not smaller than 5 mm. The plurality of apertures each has a size that is sufficiently small for preventing debris of a broken wafer from being sucked into the vacuum system. The multiplicity of apertures in the screen each has a size between about 0.01 mm and about 0.5 mm, or preferably between about 0.02 mm and about 0.08 mm. The top surface of the support plate may further include a raised edge portion adapted for containing the screen therein by frictional engagement. The support plate may be formed of metal. The screen may have a thickness of less than 2 mm.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENTS

The present invention discloses an apparatus and a method for mounting a wafer in a polishing machine by using a wafer mounting plate that is equipped with a screen such that debris from a wafer breakage is prevented from entering a vacuum system used for holding the wafer.

The wafer mounting plate is constructed of a metal plate generally of circular shape and has a plurality of holes therethrough. The metal plate has a bottom surface for engaging a membrane member and a wafer by vacuum applied through the plurality of holes and a top surface for engaging a pressurizing means such as a pneumatic gasket. The wafer mounting plate further includes a screen that is mounted to the metal plate for contacting the top surface of the metal plate, the screen has a multiplicity of apertures therethrough each has a size not larger than 0.5 mm in diameter, and preferably has a size between about 0.02 mm and about 0.08 mm. The screen is mounted sandwiched between the top surface of the metal plate and the pressurizing means.

The present invention is further directed to a wafer carrying head for use in a chemical mechanical polishing apparatus which includes a carrier body, a pressurizing means and a support plate. The carrier body is formed in circular shape for receiving the pressurizing means, the support plate and a wafer. The pressurizing means may be a pneumatic gasket that is situated in the carrier body for exerting a downward pressure on the support plate. The support plate may be formed of circular shape that has a plurality of vacuum passageways therethrough, a top surface and a bottom surface. The bottom surface of the support plate engages a wafer by vacuum through a membrane member. The top surface may be covered by a screen that has a multiplicity of apertures therethrough each has a diameter not larger than 0.5 mm, and preferably not larger than 0.08 mm for mating to the pressurizing means and for preventing any debris of a broken wafer from entering into a vacuum system.

Figure 1A:
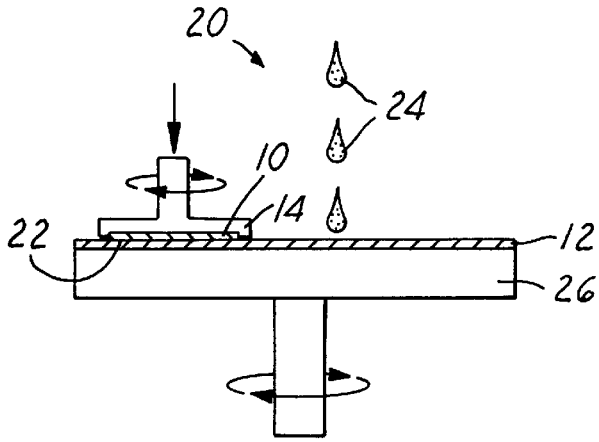
(PRIOR ART) FIG.1A
FIG. 1A is a cross-sectional view of a conventional chemical mechanical polishing apparatus.
Figure 1B:
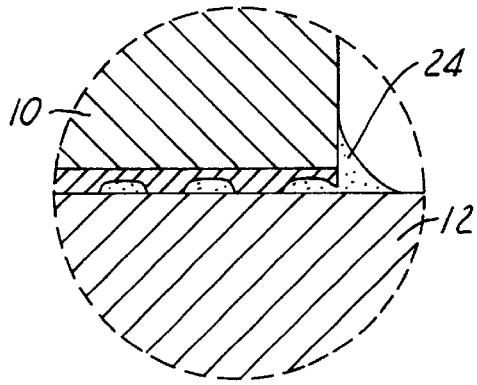
(PRIOR ART) FIG.1B
FIG. 1B is a partial, enlarged, cross-sectional view illustrating slurry interaction between a wafer surface and a polishing pad.
Figure 1C:
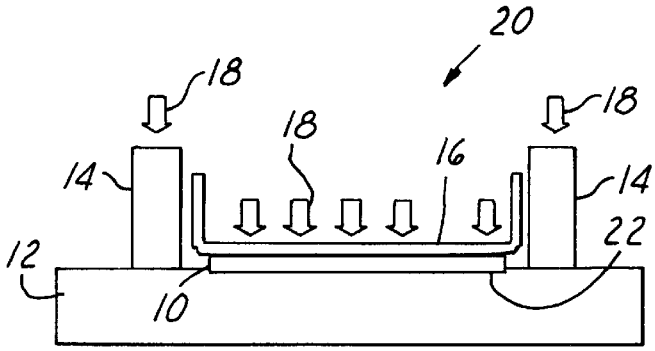
(PRIOR ART) FIG.1C
FIG. 1C is a cross-sectional view of an improved wafer holder for a conventional chemical mechanical polishing apparatus.
Figure 1D:
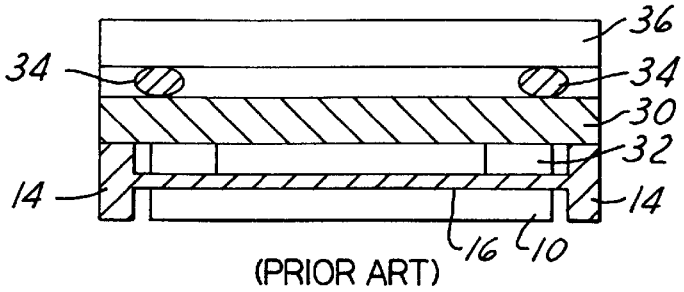
(PRIOR ART) FIG.1D
FIG. 1D is a more detailed cross-sectional view of the improved wafer holder of FIG. 1C.
Figure 3A:
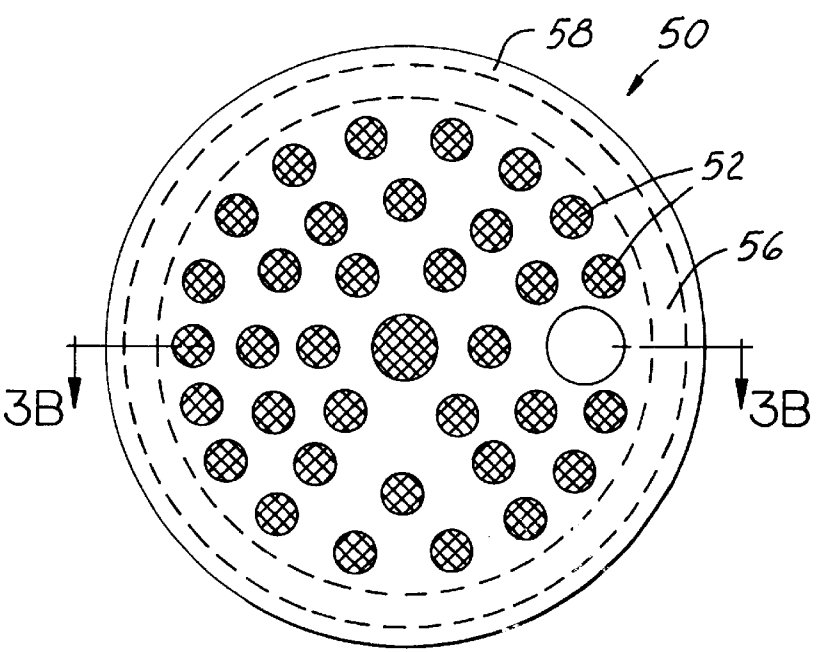
FIG. 3A is a bottom view of a present invention wafer mounting plate equipped with a screen.
Figure 3B:
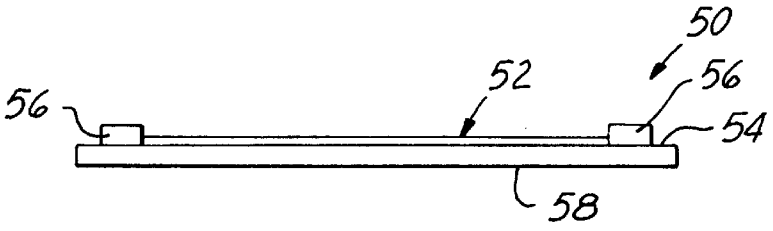
FIG. 3B is a cross-sectional view of the wafer mounting plate of FIG. 3A.
Figure 2A:
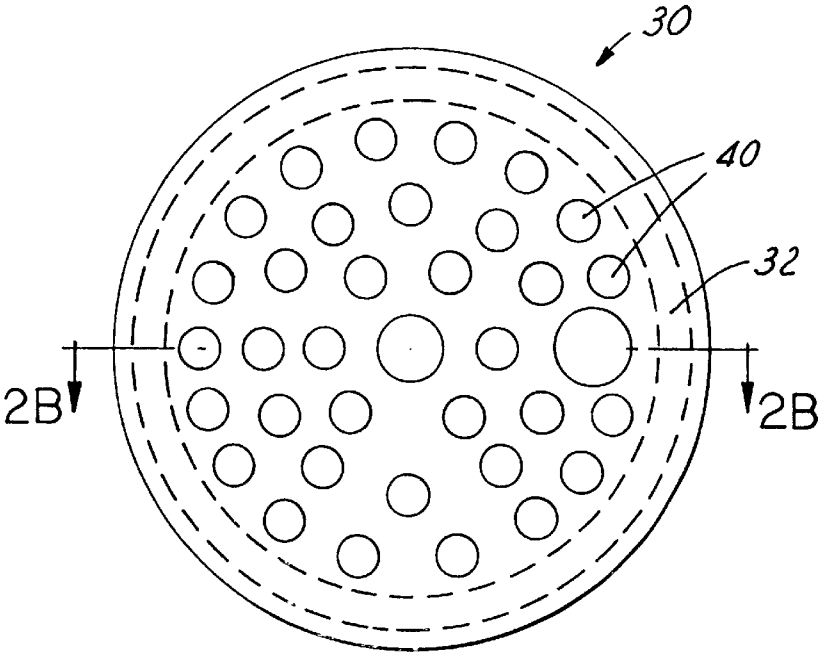
(PRIOR ART) FIG.2A
FIG. 2A is a plane view of a wafer mounting plate in the conventional chemical mechanical polishing apparatus.
Figure 2B:
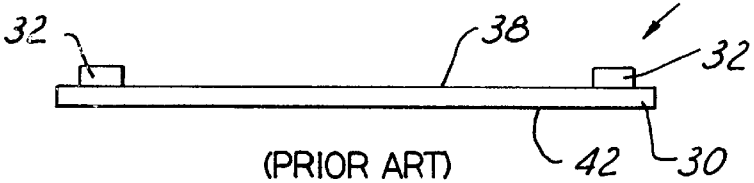
(PRIOR ART) FIG.2B
FIG. 2B is a cross-sectional view of the wafer mounting plate of FIG. 2A.

Referring now to FIG. 3A wherein a bottom view of the present invention wafer mounting plate 50 is shown, while FIG. 3B shows a cross-sectional view of the present invention wafer mounting plate 50 taken at the centerline of the plate. From FIG. 3B, it is seen that a screen 52 is mounted to a top surface 54 of the plate 50. The terms "top" and "bottom" are used herein to denote the surfaces when the plate is mounted into a CMP apparatus in an operating position. The screen 50 is mounted inside a raised edge portion 56 by either a frictional engaging means or by an adhesive means to the top surface 54 of the plate 50. The bottom surface 58 of the wafer mounting plate 50 is mounted to a membrane member (not shown) before the mounting of a wafer onto the membrane member.

The screen 52 may be supplied in a metal mesh which has a multiplicity of openings with diameters of about 0.05 mm±0.03 mm, or in a range between about 0.02 mm and about 0.08 mm. However, any metal mesh that has openings in the range between about 0.01 mm and about 0.5 mm may also be used for preventing debris of a wafer breakage from entering the vacuum system used for holding the wafer. The membrane member (not shown) should be fabricated of an elastomeric material that has a Durometer A scale of less than 70 to provide the necessary pliability for holding the wafer.

The present invention novel apparatus and method for mounting a wafer in a polishing apparatus by using a wafer mounting plate that is equipped with a screen for preventing debris of a wafer breakage from entering a vacuum system have therefore been amply described in the above description and in the appended drawing of FIG. 3.

While the present invention has been described in an illustrative manner, it should be understood that the terminology used is intended to be in a nature of words of description rather than of limitation.

Furthermore, while the present invention has been described in terms of a preferred embodiment, it is to be appreciated that those skilled in the art will readily apply these teachings to other possible variations of the inventions.

The embodiment of the invention in which an exclusive property or privilege is claimed are defined as follows.

What is claimed is:

1. A wafer mounting device for use in a polishing apparatus comprising:

a pressurizing plate;

a mounting plate of circular shape having a plurality of holes therethrough, said mounting plate having a bottom surface for engaging a membrane member and a wafer by vacuum through said plurality of holes and a top surface for engaging said pressurizing plate; and a screen mounted to and contacting said top surface of the mounting plate having a multiplicity of apertures each having a size not larger than 0.5 mm in diameter, said screen being mounted sandwiched between said top surface of the mounting plate and said pressurizing plate.

2. A wafer mounting plate for use in a polishing apparatus according to claim 1, wherein said plurality of holes in said metal plate each having a diameter of not smaller than 5 mm.

3. A wafer mounting plate for use in a polishing apparatus according to claim 1, wherein said membrane member being perforated with holes for vacuum to be pulled therethrough.

4. A wafer mounting plate for use in a polishing apparatus according to claim 1, wherein said membrane member being fabricated of a material that has a flexibility sufficient to prevent wafer breakage during loading or unloading of a wafer in said polishing apparatus.

5. A wafer mounting plate for use in a polishing apparatus according to claim 1, wherein said membrane member being fabricated of an elastomeric material having a Durometer A scale less than 70.

6. A wafer mounting plate for use in a polishing apparatus according to claim 1, wherein said screen having a thickness of less than 2 mm.

7. A wafer mounting plate for use in a polishing apparatus according to claim 1, wherein said plurality of apertures each having a size that is sufficiently small for preventing debris of a broken wafer from being sucked into the vacuum system.

8. A wafer mounting plate for use in a polishing apparatus according to claim 1, wherein said multiplicity of apertures in said screen each having a size between about 0.01 mm and about 0.5 mm.

9. A wafer mounting plate for use in a polishing apparatus according to claim 1, wherein said multiplicity of apertures in said screen each having a size preferably between about 0.02 mm and about 0.08 mm.

10. A wafer mounting plate for use in a polishing apparatus according to claim 1, wherein said top surface of said metal plate further comprises a raised edge portion adapted for containing said screen therein by frictional engagement.

11. A wafer carrying head in a chemical mechanical polishing apparatus comprising:

a carrier body of generally circular shape for receiving a pressurizing means, a support plate and a wafer therein;

a pressurizing means situated in said carrier body for exerting a downward pressure on said support plate; and a support plate of circular shape having a plurality of vacuum passageways therethrough each having a diameter not smaller than 5 mm, a top surface and a bottom surface, said bottom surface engages a wafer by vacuum through a membrane member, said top surface being covered by a screen having a multiplicity of apertures therethrough each having a diameter not larger than 0.5 mm for mating to said pressurizing means and for preventing any debris of a broken wafer from entering into said vacuum.

12. A wafer carrying head in a chemical mechanical polishing apparatus according to claim 11, wherein said membrane member having perforations therethrough.

13. A wafer carrying head in a chemical mechanical polishing apparatus according to claim 11, wherein said membrane member having a flexibility sufficient to prevent wafer breakage during wafer loading and unloading in the chemical mechanical polishing apparatus.

14. A wafer carrying head in a chemical mechanical polishing apparatus according to claim 11, wherein said multiplicity of apertures each having a size that is sufficiently small for preventing debris of a broken wafer from being sucked into the vacuum system.

15. A wafer carrying head in a chemical mechanical polishing apparatus according to claim 11, wherein said multiplicity of apertures in said screen each having a size between about 0.01 mm and about 0.5 mm.

16. A wafer carrying head in a chemical mechanical polishing apparatus according to claim 11, wherein said multiplicity of apertures in said screen each having a size between about 0.02 mm and about 0.08 mm.

17. A wafer carrying head in a chemical mechanical polishing apparatus according to claim 11, wherein said top surface of said support plate further comprises a raised edge portion adapted for containing said screen therein by frictional engagement.

18. A wafer carrying head in a chemical mechanical polishing apparatus according to claim 11, wherein said support plate being formed of metal.

19. A wafer carrying head in a chemical mechanical polishing apparatus according to claim 11, wherein said screen having a thickness of less than 2 mm.

* * * * *